United States Patent [19]

Raab et al.

[11] 4,168,405

[45] Sep. 18, 1979

[54] ELECTRICAL REVERSING SWITCH

[75] Inventors: Andrew F. Raab, Morton Grove; William J. Schaad, Winnetka, both of Ill.

[73] Assignee: Indak Manufacturing Corp., Northbrook, Ill.

[21] Appl. No.: 882,663

[22] Filed: Mar. 2, 1978

[51] Int. Cl.[2] ..... H01H 9/30; H01H 15/00

[52] U.S. Cl. ..... 200/1 V; 200/16 C; 200/144 R

[58] Field of Search ..... 200/1 V, 16 R, 16 C, 200/16 D, 61.86, 144 R

[56] References Cited

U.S. PATENT DOCUMENTS

| | | | |
|---|---|---|---|
| 3,188,697 | 6/1965 | Schink | 200/16 C |
| 3,235,679 | 2/1966 | Schaad et al. | 200/16 C |
| 3,472,975 | 10/1969 | Soreng et al. | 200/16 C |
| 3,500,002 | 3/1970 | Bedocs | 200/16 C |
| 3,500,003 | 3/1970 | Schink | 200/16 C |
| 4,054,761 | 10/1977 | Raab et al. | 200/16 C |

*Primary Examiner*—James R. Scott

*Attorney, Agent, or Firm*—Burmeister, York, Palmatier, Hamby & Jones

[57] ABSTRACT

The switch comprises two contactors movable along two rows of four contacts, to an "OFF" position in which each contactor bridges the second and third contacts in each row, a first "ON" position in which each contactor bridges the first and third contacts in each row, and a second "ON" position in which each contactor bridges the second and fourth contacts in each row. An inner crossover conductor extends between the first contact in the first row and the fourth contact in the second row and is disposed between the first and second rows. A second crossover conductor is on the outer side of the contact supporting board and is connected between the second contact in the first row and the third contact in the second row. A flat Z-shaped insulating member is held captive between the board and the inner crossover conductor.

20 Claims, 35 Drawing Figures

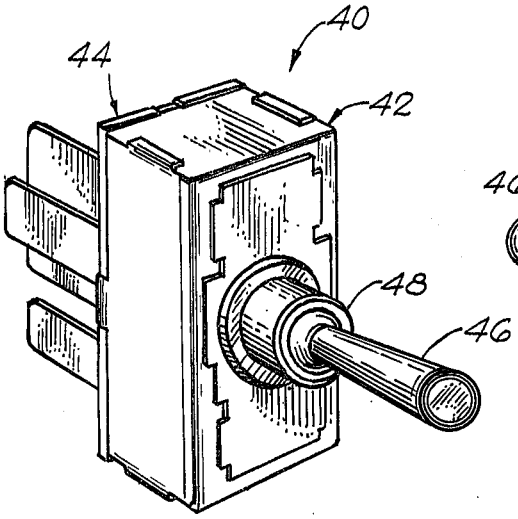
FIG. 1
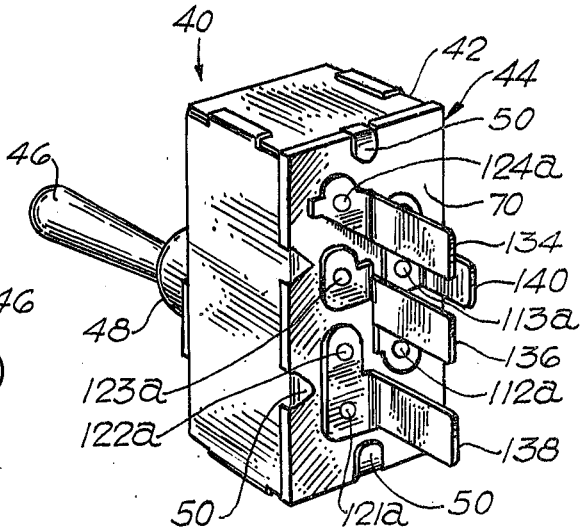
FIG. 2
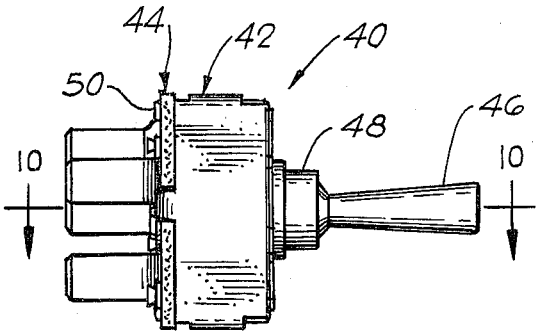
FIG. 3
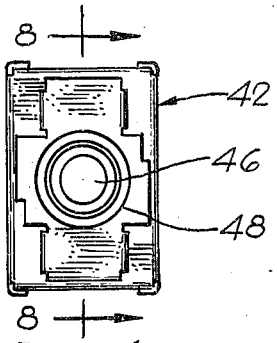
FIG. 4
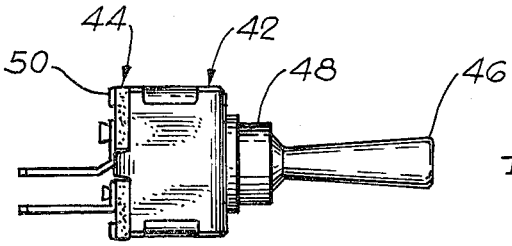
FIG. 5
FIG. 7
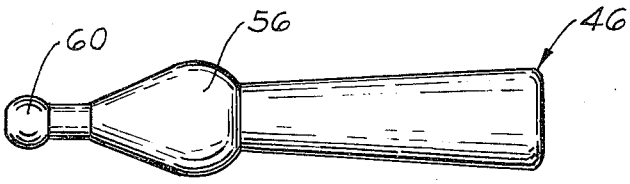
FIG. 6
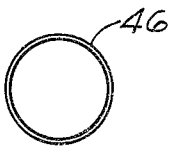

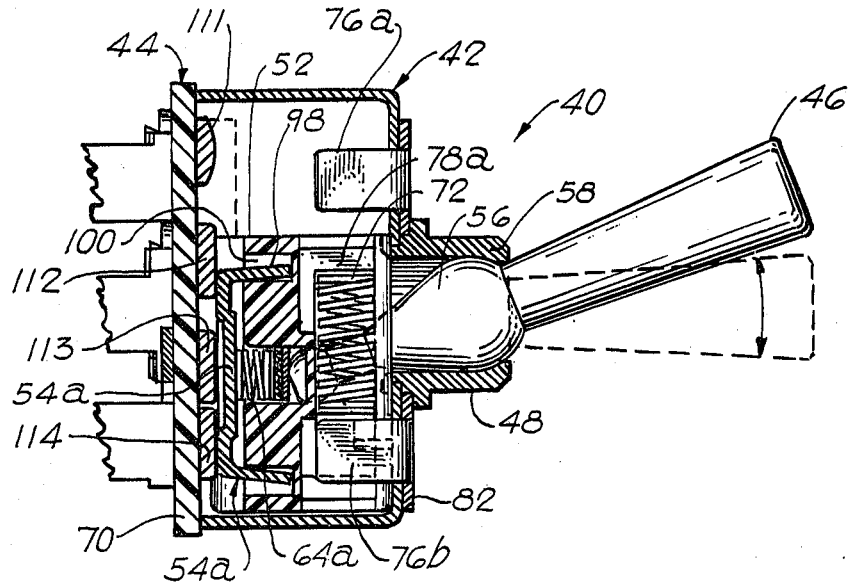
FIG. 8
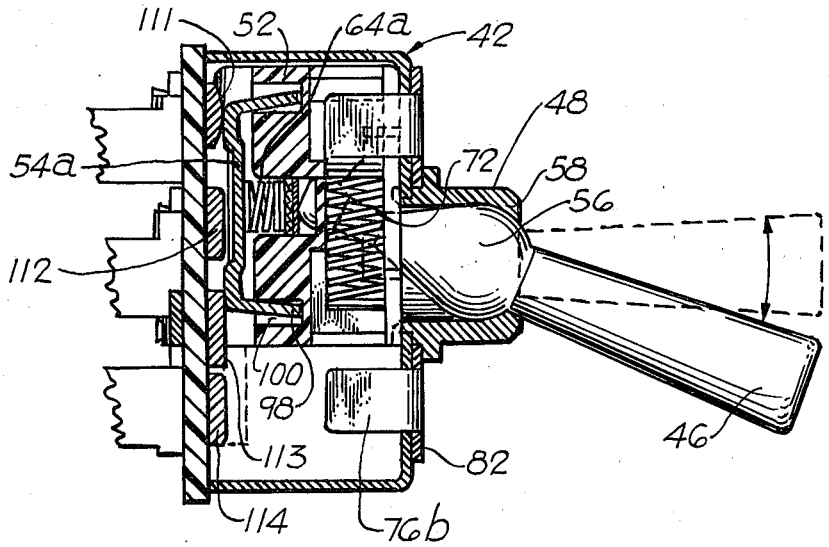
FIG. 9
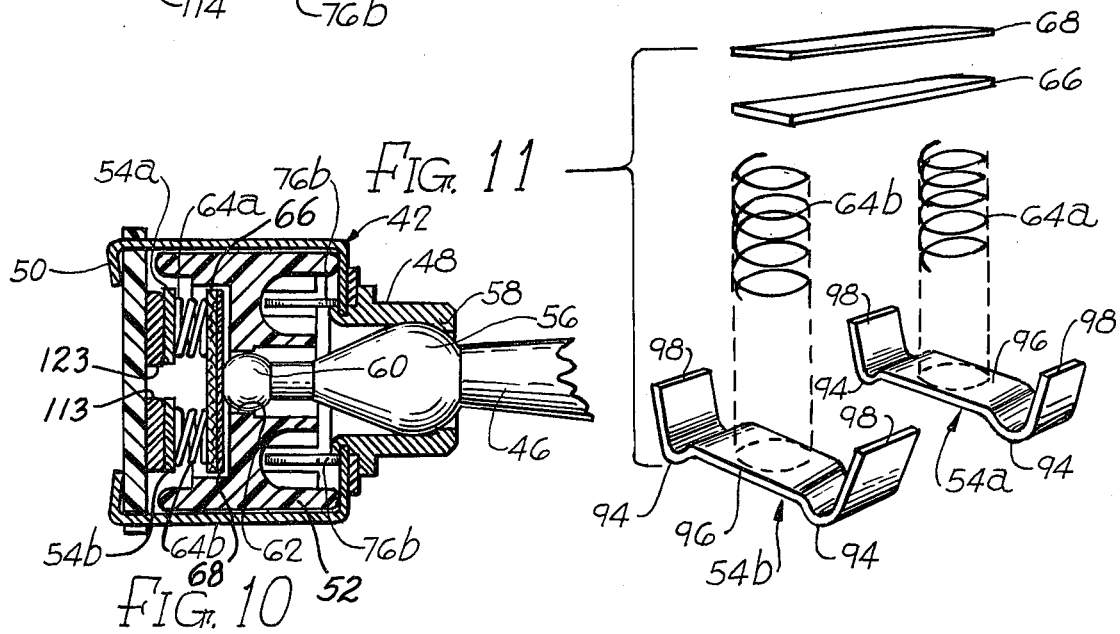
FIG. 11
FIG. 10

42
48
50
52
62
72
74
76a
76b
78a
78b
82
84
86
88
90
100
102
104
156
158
160

ELECTRICAL REVERSING SWITCH

This invention relates to electrical reversing switches, which will find many applications, but are particularly well adapted for automotive service, in automobiles, trucks and other automotive vehicles having direct current electrical systems.

FIELD OF THE INVENTION

Such vehicles frequently include electrical reversing switches which are employed to control the operation of reversible direct current motors, particularly motors of the type having permanent magnet fields. Such motors are commonly used for raising and lowering windows, raising and lowering radio antennas, adjusting the positions of power operated seats, and providing the motive power for carrying out other control functions.

DESCRIPTION OF PRIOR ART

One object of the present invention is to provide a new and improved electrical reversing switch which is self-contained, in that the switch incorporates crossover conductors, so that the switch needs to have only two power supply terminals, to be connected to the battery, and two output terminals, to be connected to the reversible electric motor.

A further object is to provide such a new and improved reversing switch in which the crossover conductors are provided in a highly ingenious and economical manner.

Another object is to provide a new and improved electrical reversing switch having an OFF position, in which the output terminals are shortcircuited, so as to provide dynamic braking, when the output terminals are connected to the armature of a reversible electric motor of the permanent magnet type.

A further object is to provide a new and improved switch in which a heat resistant insulating member is held captive in an ingenious manner against the insulating terminal board and between contacts on such board, to keep the contactors away from the terminal board and thereby prevent or minimize burning of the terminal board by the arcing which may occur between the contactors and the contacts.

SUMMARY OF THE INVENTION

To achieve these objects, the present invention may provide an electrical reversing switch, comprising a housing, first and second conductive contactors movable in the housing, means in the housing for moving the contactors along first and second predetermined parallel paths, an insulating terminal board on the housing and extending adjacent such paths, first and second rows of contact rivets on the terminal board and selectively engageable by the respective contactors, each of the rows preferably comprising four contact rivets spaced along the path of the corresponding contactor, the contactors being movable to an OFF position in which each contactor forms a bridge between the second and third contact rivets in the corresponding row, the contactors being movable to a first ON position in which each contactor forms a bridge between the first and third contact rivets in the corresponding row, the contactors being movable in the opposite direction to a second ON position in which each contactor forms a bridge between the second and fourth rivets in the corresponding row, the rivets having heads on the inner side of the terminal board and engageable by the contactors, the rivets having shanks extending through openings in the terminal board to the other side thereof, a first crossover conductor extending between the heads of the first contact rivet in the first row and the fourth contact rivet in the second row, the first crossover conductor extending along the terminal board between the first and second rows, a first terminal connected to the shank of one of the contact rivets engaged by the first crossover conductor, a second crossover conductor on the outer side of the terminal board and connected between the shanks of the second contact rivet in the first row and the third contact rivet in the second row, a second terminal connected to the second crossover conductor, a third terminal on the outer side of the terminal board and connected to the shanks of the third and fourth rivets in the first row, and a fourth terminal on the outer side of the terminal board and connected to the shanks of the first and second rivets in the second row.

The second crossover conductor preferably comprises a terminal bar projecting rearwardly from the terminal board and having first and second flanges extending in opposite directions therefrom and connected to the shanks of the second rivet in the first row and the third rivet in the second row, respectively.

The first crossover conductor preferably comprises a connector bar extending edgewise along the inner side of the terminal board and projecting forwardly therefrom, the connector bar having first and second flanges extending laterally in opposite directions from opposite end portions of the connector bar and connected respectively to the heads of the first rivet in the first row and the fourth rivet in the second row.

The switch preferably includes a flat generally Z-shaped insulating member having a longitudinal leg held captive between the terminal board and the first crossover conductor, the longitudinal leg also being held captive between the first and second rows of contact rivets, the insulating member having a first lateral leg extending between the heads of the first and second contact rivets in the first row to keep the first contactor away from the terminal board, the insulating member having a second lateral leg extending between the heads of the third and fourth rivets in the second row to keep the second contactor away from the terminal board, the lateral legs of the insulating member being effective to prevent the terminal board from being burned by arcing between each contactor and the corresponding rivets. Such insulating member is preferably made of a heat resistant material to minimize damage to the insulating member due to such arcing.

In certain aspects, the invention is also applicable to other types of reversing switches, such as switches in which the output circuit is not shortcircuited when the switch is in its OFF position.

BRIEF DESCRIPTION OF THE DRAWINGS

Further objects, advantages and features of the present invention will appear from the following description, taken with the accompanying drawings, in which:

FIGS. 1 and 2 are front and rear perspective views of an electrical reversing switch to be described as an illustrative embodiment of the present invention.

FIGS. 3 and 4 are front and side elevations of the reversing switch.

FIG. 5 is a top view of the switch.

FIGS. 6 and 7 are enlarged elevation and end views of the operating lever for the switch.

FIG. 8 is an enlarged longitudinal section through the switch, taken generally along the line 8—8 in FIG. 4, the switch being shown in one of its ON positions, the OFF position of the control lever being indicated in broken lines.

FIG. 9 is a section similar to FIG. 8, but with the switch in its other ON position.

FIG. 10 is a transverse section, taken generally along the line 10—10 in FIG. 3.

FIG. 11 is an exploded perspective view showing the contactors for the switch, together with the contactor pressure springs and associated components.

DESCRIPTION OF THE PREFERRED EMBODIMENT

Figure 12:
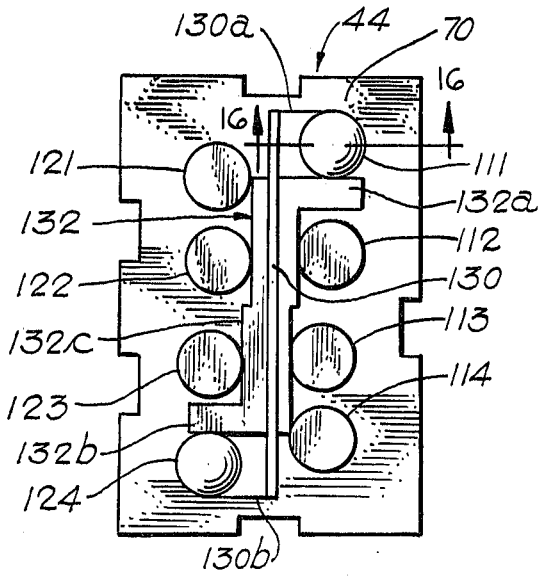
FIG. 12 is an enlarged front view of the terminal head assembly for the switch, comprising the terminal board, contact rivets and associated components.

As just indicated, the drawings illustrate an embodiment of the present invention, in the form of an electrical reversing switch 40. As shown in FIGS. 1-5, the switch 40 comprises a housing or casing 42, closed at its rear end by a terminal head assembly 44. The illustrated housing 42 is made of sheet metal, but the housing may be made of a resinous plastic material, or other suitable materials. The illustrated switch 40 has a forwardly projecting operating lever 46, but other means may be provided for operating the switch, if desired. The lever 46 is swingably mounted in a bushing 48, projecting forwardly from the housing 42. In this case, the terminal head assembly 44 is secured to the rear of the housing 42 by tabs 50, formed on the housing 42 and bent behind the terminal head assembly 44.

As shown in FIGS. 8-11, the swingable lever 46 is adapted to move an insulating carriage 52 in a longitudinal direction within the housing 42. The lever 46 and the carriage 52 constitute means for moving first and second contactors 54*a* and 54*b* along parallel longitudinal paths within the housing 42. The contactors 54*a* and 54*b* are selectively engageable with contacts on the terminal head assembly 44, as will be described in greater detail presently.

Various mechanical details of the switch 40 are shown in FIGS. 8-11. The illustrated lever 46 has a spherically curved ball formation 56 which is swingable in a spherically curved socket or seat formation 58 in the bushing 48. The rear end of the operating lever 46 has a smaller, spherically curved ball formation 60 which is received in a circular opening 62, formed in the insulating carriage 52. The lever 46 and the bushing 48 are preferably made of metal, but may be made of resinous plastic or other materials. The insulating carriage 52 is preferably made of a resinous plastic material.

The contactors 54*a* and 54*b* are biased toward the terminal head assembly 44 by resilient means, illustrated as compression coil springs 64*a* and 64*b*. Preferably, the springs 64*a* and 64*b* also bias the lever 46 forwardly, so as to press the ball formation 56 into the socket formation 58. As shown, the rear ends of the springs 64*a* and 64*b* press against the contactors 54*a* and 54*b*. The front ends of the springs 64*a* and 64*b* press against a pair of superimposed bars 66 and 68 which transmit the force of the springs 64*a* and 64*b* to the ball formation 60 at the rear end of the operating lever 46. One of the bars, in this case the bar 66, is an electrical insulator, made of a suitable insulating material, such as a resinous plastic material. The other bar, in this case the bar 68, is a force transmitting member, providing mechanical strength and resistance to breakage. Thus, the bar 68 may be made of spring steel, or some other suitable material. The insulator 66 interrupts the conductive path which would otherwise be formed between the contactors 54*a* and 54*b* by the springs 64*a* and 64*b* and the metal bar 68.

The terminal head assembly 44 includes an insulating terminal board 70 which forms the rear wall of the housing 42. The carriage 52 is slidable longitudinally within the housing 42 and is guided by the terminal board 70 and the walls of the housing 42.

Figures 25, 26, 27, 28, 29, 30, 31, 32, 33, 34, 35:
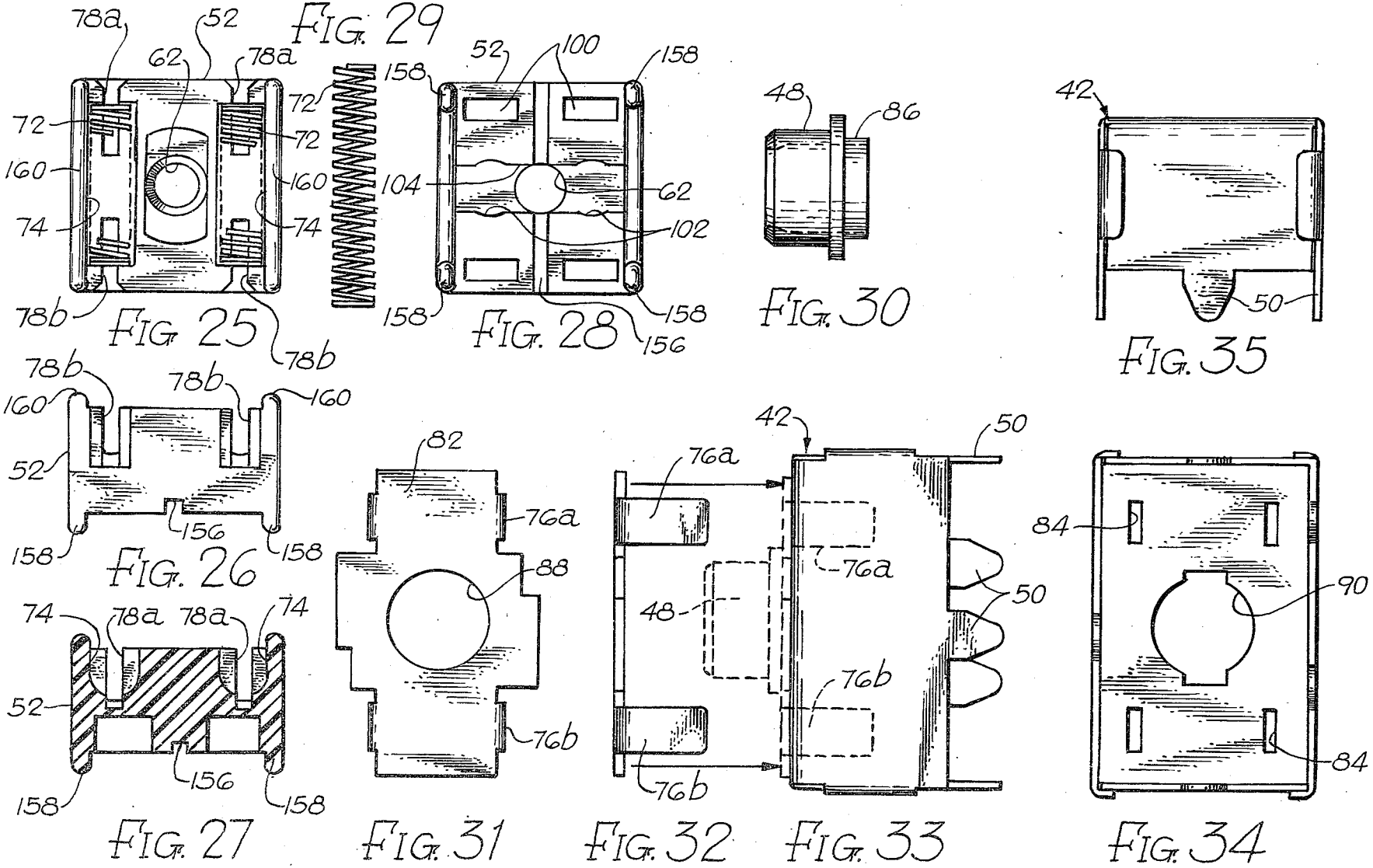
FIG. 25 is an enlarged front view showing the insulating carriage of the switch, together with the carriage return springs.
FIG. 26 is an end view of the carriage.
FIG. 27 is a cross section taken through the carriage.
FIG. 28 is a rear view of the carriage.
FIG. 29 is an elevational view showing one of the carriage return springs.
FIG. 30 is a side view showing the bushing for supporting the operating lever.
FIGS. 31 and 32 are front and side views of a flanged plate adapted to be mounted on the front of the housing.
FIGS. 33, 34 and 35 are side, rear and end views of the housing for the switch.

In this case, the switch 40 is of the spring return type. Thus, the carriage 52 is resiliently biased to a central OFF position, and is movable in opposite directions to the two ON positions shown in FIGS. 8 and 9. The central OFF position of the operating lever 46 is shown in broken lines in FIGS. 8 and 9. In this case, the spring return action is provided by resilient means, illustrated as a pair of compression coil springs 72. As shown to best advantage in FIG. 25, the springs 72 are adapted to be received in a pair of longitudinal recesses or pockets 74, formed in the front side of the carriage 52. Initially, the return springs are compressed between the upper and lower end walls of the pockets 74, as shown in FIG. 25. The ends of the springs 72 are engageable with upper and lower spring stops 76*a* and 76*b* on the housing 42. In this case, the stops 76*a* and 76*b* take the form of rearwardly projecting tabs or flanges which are slidably received in upper and lower slots 78*a* and 78*b* in the carriage 52. It will be seen from FIG. 25 that the slots 78*a* and 78*b* enter the upper and lower ends of the spring pockets 74.

When the carriage 52 is moved downwardly by swinging the lever 46 upwardly, as shown in FIG. 8, the return springs 72 are pressed between the lower spring stops 76*b* and the upper ends of the spring pockets 74. When the carriage 52 is moved upwardly by swinging the operating lever 46 downwardly, as shown in FIG. 9, the return springs 72 are compressed between the upper spring stops 76*a* and the lower ends of the spring pockets 74.

As shown in FIGS. 8–10, and also in FIGS. 30–35, the rearwardly projecting flanges or tabs 76*a* are formed in this instance on a plate 82 which is mounted on the front of the housing 42. The tabs 76*a* and 76*b* extend rearwardly through slots 84 in the front wall of the housing 42. In this case, the bushing 48 is employed to secure the plate 82 to the housing 42. Thus, the illustrated bushing 48 has a reduced rear member 86 which extends through an opening 88 in the plate 82, and also through an opening 90 in the front wall of the housing 42. The bushing 48 is secured to the housing 42 by upsetting the rear member 86 of the bushing. Thus, the bushing clamps the plate 82 against the front wall of the housing 42.

As shown in FIG. 11, each of the contactors 54*a* and 54*b* may be in the form of a strip or bar of conductive material, such as copper. In this case, each of the conductors 54*a* and 54*b* has a pair of projections 94, directed rearwardly, with a forwardly offset connecting member 96 extending therebetween. Means are provided to mount the contactors 54*a* and 54*b* on the insulating carriage 52 and to guide the contactors for rearward and forward movement relative to the carriage 52. As shown in FIGS. 8–11, such means may comprise guide tabs or flanges 98 bent forwardly on both ends of each contactor. The flanges 98 are slidably received in slots 100 formed in the rear side of the carriage 52. The contactor springs 64*a* and 64*b* are received and located in recesses or seats 102 formed in the rear side of the carriage 52. The backup bars 66 and 68 for the springs 64*a* and 64*b* are movably received in a transverse slot 104 which extends between the spring seats 102.

The terminal head assembly 14 is illustrated in further detail in FIGS. 12–20. As shown in FIG. 12, the insulating terminal board 70 carries two parallel rows of contacts which are spaced along the paths of the corresponding contactors 54*a* and 54*b*. The contacts in the first row are designated 111, 112, 113 and 114, while the contacts in the second row are designated 121, 122, 123 and 124. The contacts are made of a highly conductive material, such as copper, which may be plated in some instances with silver or tin. In some cases, the contacts may be made of solid silver.

In the illustrated construction, the contacts 111–114 and 121–124 are in the form of rivet heads having reduced shanks 111*a*–114*a* and 121*a*–124*a*, extending through corresponding openings in the insulating terminal board 70 and projecting rearwardly from the terminal board.

Figure 21:
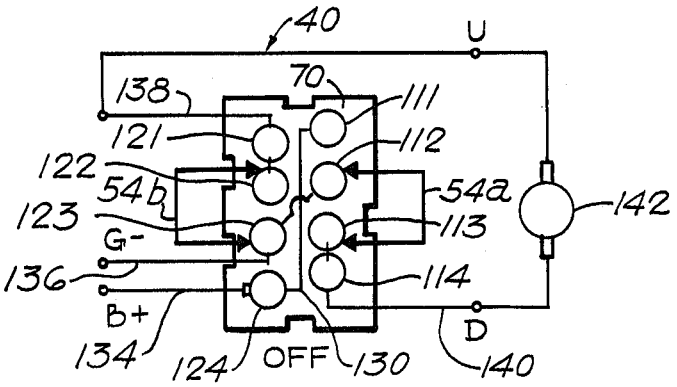
FIGS. 21, 22 and 23 are schematic circuit diagrams showing the OFF position and the two ON positions of the switch.
Figure 22:
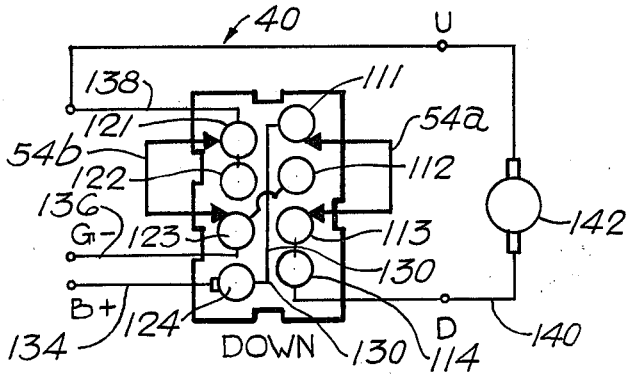
Figure 23:
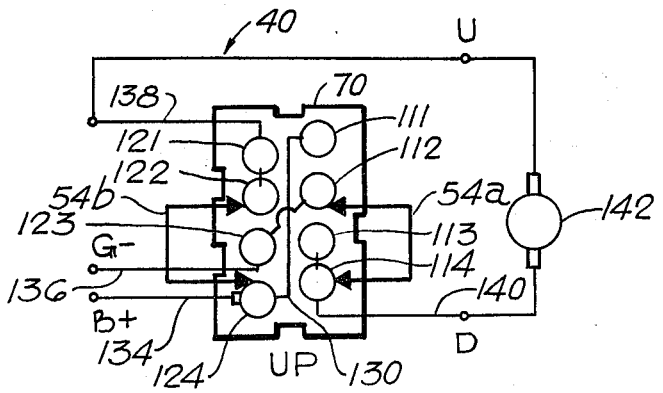
Figure 24:
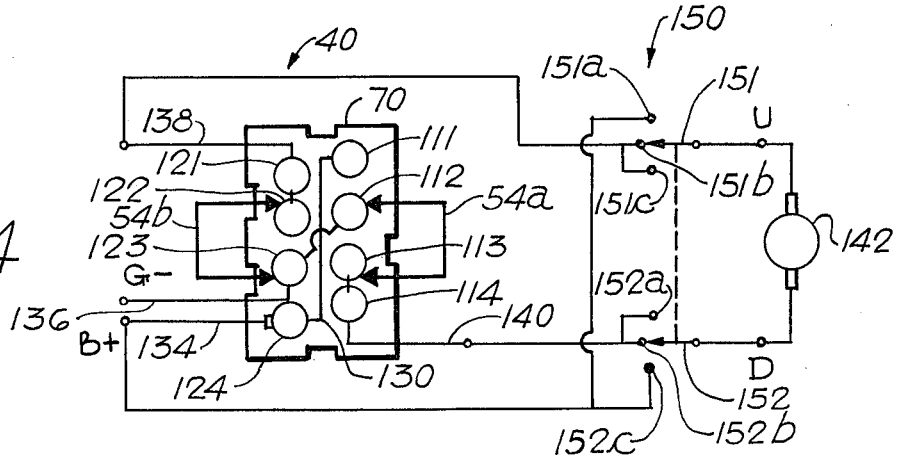
FIG. 24 is a modified circuit diagram, showing the use of the reversing switch in conjunction with a second reversing switch.

This action of the contactors 54*a* and 54*b* is shown diagrammatically in FIGS. 21–23, which should be considered in connection with FIGS. 8, 9, 12 and 13. When the contactors 54*a* and 54*b* are in their OFF position, as shown in FIG. 21, the contactor 54*a* forms a bridge between the contacts 112 and 113, while the contactor 54*b* forms a conductive bridge between the contacts 122 and 123. When the contactors 54*a* and 54*b* are moved upwardly to the first ON position of FIG. 22, the contactor 54*a* forms a bridge between the contacts 111 and 113, while the contactor 54*b* forms a bridge between the contacts 121 and 123. When the contactor is moved downwardly to its second ON position, as shown in FIG. 23, the contactor 54*a* forms a bridge between the contacts 112 and 114, while the contactor 54*b* forms a bridge between the contacts 122 and 124. It will be noted that the first ON position corresponds with downward movement of the operating lever 46 and thus, is called DOWN. The second ON position corresponds with upward movement of the operating lever 46 and thus is called UP.

In order that the switch 40 may constitute a self-contained reversing switch, the switch 40 is provided with crossover connections which are highly ingenious in construction. As shown in FIG. 12, the first contact 111 in the first row and the fourth contact 124 in the second row are connected together by a first crossover conductor 130 which is mounted on the front or inner side of the terminal board 70, between the two rows of contacts. It will be seen from FIGS. 12, 17 and 18 that the crossover conductor 130 is preferably in the form of a conductive metal bar or strip which is mounted edgewise along the insulating terminal board 70 and projects forwardly therefrom, between the two rows of contacts. The conductor bar 130 has terminal flanges or tabs 130*a* and 130*b* which project laterally in opposite directions from the opposite ends of the bar 130 and are apertured to receive the rivet shanks 111*a* and 124*a* of the rivet head contacts 111 and 124. Thus, the terminal tabs 130*a* and 130*b* are clamped between the terminal board 70 and the rivet head contacts 111 and 124. It is preferred to provide silver plating on the conductor bar 130, the tabs 130*a* and 130*b*, and the contacts 111 and 124, to afford enhanced conductivity so that the current carrying capacity of the switch will be increased.

Figure 19:
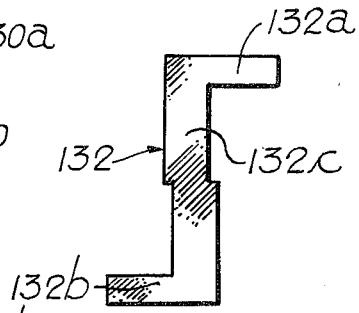
FIGS. 19 and 20 are front and edge views of an insulating member, also shown in FIG. 12.
Figure 20:
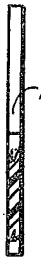

To enhance the ability of the switch to withstand arcing, it is preferred to provide a substantially flat insulating member 132 on the terminal head assembly 44. As shown in FIGS. 12, 19 and 20, the insulating member 132 is generally Z-shaped, and is provided with arms 132*a* and 132*b* projecting laterally in opposite directions from a central or longitudinal leg 134*c*. The insulating member 132 is preferably made of a material which is highly resistant to hear. Thus, for example, various heat resistant resinous plastic materials may be employed, such as glass fabric melamine.

It will be seen from FIG. 12 that the first laterally projecting arm 132*a* of the insulating member 132 extends between the first and second contacts 111 and 112 in the first row and is adjacent the first contact 111. The second laterally projecting arm 132*b* extends between the third and fourth contacts 123 and 124 in the second row and is adjacent the fourth contact 124. In the usual hookup of the switch 40, as shown in FIGS. 21–23, the contacts 111 and 124 are connected to the positive terminal of the battery circuit, such terminal being designated B+. Most of the arcing occurs between the respective contacts 111 and 124 and the corresponding contactors 54*a* and 54*b*, when the circuit is broken. The arms 132*a* and 132*b* of the heat resistant insulating member 132 keep the contactors 54*a* and 54*b* away from the terminal board 70, as the contactors are moved into and out of engagement with the corresponding contacts 111 and 124, so that the arcing is kept away from the terminal board 70. In this way, the terminal board 70 is protected from the heat generated by the arcing, so that burning of the terminal board is prevented or minimized. The insulating arms 132*a* and 132*b* are highly resistant to the heat of the arcs produced at the contacts 111 and 124.

The insulating member 132 is mounted on the terminal board 70 in an ingenious manner. It will be seen that the insulating member 132 is held captive between the crossover bar 130 and the terminal board 70. Thus, the crossover bar 130 clamps the flat insulating member 132 against the front side of the terminal board 70. In addition, the insulating member 132 is held captive against lateral movement between the first and second rows of contacts 111–114 and 121–124. Thus, the edges of the central leg 132*c* are retained between the edge portions of the contacts 112, 113, 114, 121, 122 and 123. The flat insulating member 132 is held captive against longitudinal movement between the terminal tabs 130*a* and 130*b* of the crossover conductor 130. Thus, the upper edge of the arm 132*a* is confined by the terminal tab 130*a*, while the lower edge of the arm 132*b* is confined by the terminal tab 130*b*.

Figure 13:
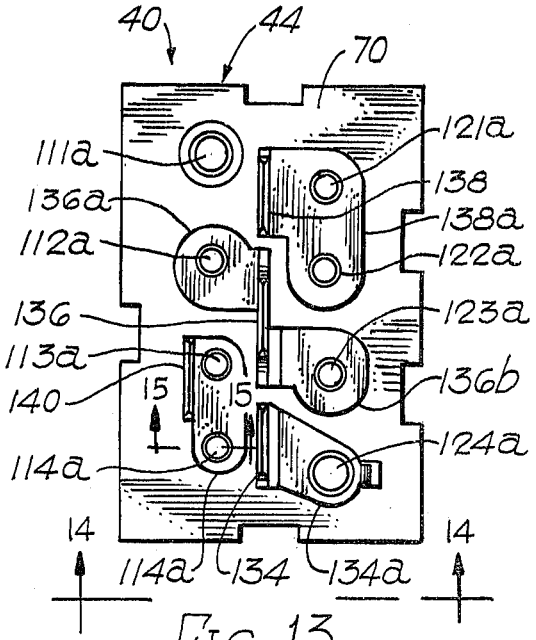
FIG. 13 is an enlarged rear view of the terminal head assembly, showing the terminals and associated components.

As shown in FIG. 13, a first terminal 134 is connected to one of the two contacts 111 and 124 which are engaged by the first crossover bar 130. In this case, the first terminal 134 is formed with a laterally projecting flange or wing 134*a* which is mounted on the rivet shank 124*a* of the contact 124. The rivet shank 124*a* is upset, so as to clamp the terminal tab 134*a* against the rear side of the insulating board 70. The terminal 134 is in the form of a blade or lug which projects rearwardly from the terminal board 70 and is adapted to mate with one terminal of a receptacle or connector.

The reversing switch 40 is provided with a second crossover conductor 136, which is mounted on the rear or outer side of the terminal board 70, as shown in FIG. 13. In this case, the crossover conductor 136 takes the form of a terminal bar having two laterally projecting wings or flanges 136*a* and 136*b* which project in opposite directions, for connection to the rivet shanks 112*a* and 123*a*. The terminal wings 136*a* and 136*b* are clamped against the terminal board 70 by the upsetting of the rivet shanks 112*a* and 123*a*. Thus, the second crossover conductor 136 is connected between the second contact 112 in the first row and the third contact 123 in the second row. The terminal bar 136 is in the form of a rearwardly projecting blade or lug, adapted to mate with a second terminal of a receptacle or connector.

As shown in FIG. 13, the switch 40 has a third terminal 138 in the form of a conductor bar having a laterally projecting wing 138*a* which is connected to the rivet shanks 121*a* and 122*a*. Thus, the terminal bar 138 is connected to both the first and second contacts 121 and 122 in the second row. The upsetting of the rivet shanks 121*a* and 122*a* clamps the terminal wing 138*a* against the insulating board 70. The terminal bar 138 is in the form of a blade or lug, projecting rearwardly from the insulating board 70 and adapted to mate with a third contact of a receptacle or connector.

The reversing switch 40 is provided with a fourth terminal 140 having a laterally projecting wing or tab 140*a* which is connected to the rivet shanks 113*a* and 114*a*. The upsetting of the rivet shanks 113*a* and 114*a* clamps the terminal wing 140*a* against the rear side of the insulating board 70. The terminal 140 is in the form of a blade or lug projecting rearwardly from the terminal board 70 and adapted to mate with a fourth contact of a receptacle or connector. The terminal 140 is connected to the third and fourth contacts 113 and 114 in the first row.

FIGS. 21–23 illustrate a typical circuit diagram for the reversing switch 40. The first terminal 134 may be connected to the positive battery terminal B+. The second terminal 136 may be connected to the grounded or minus battery terminal G−. The third and fourth terminals 138 and 140 are connected to the device to be controlled, which is shown as a reversible direct current motor 142, usually of the type having a permanent magnet field. Such motors are often used to provide the motive power for carrying out various control functions in automotive vehicles. For example, the motor 142 may be employed to move a window or a radio antenna up or down. Thus, the terminals of the motor 142 are labeled D for "Down" and U for "Up". When the D terminal is positive, the motor 142 will move the window down. When the U terminal is positive, the motor 142 will move the window up. The D and U terminals are connected to the armature of the motor.

When the reversing switch 40 is in its central or Off position, as shown in FIG. 21, the motor armature is shortcircuited through the terminal 138, the contact 122, the contactor 54*b*, the contact 123, the second crossover conductor 136, the contact 112, the contactor 54*a*, the contact 113 and the terminal 140, all connected in series. The short circuiting of the motor armature produces dynamic breaking of the armature and thus is advantageous.

When the reversing switch 40 is in its first On position, designated DOWN in FIG. 22, the positive battery terminal B+ is connected to the D motor terminal through the terminal 134, the first crossover conductor 130, the contact 111, the contactor 54*a*, the contact 113 and the terminal 140. The negative battery terminal G− is connected to the U motor terminal through the switch terminal 136, the contact 123, the contactor 54*b*, the contact 121 and the terminal 138. Thus, the motor 142 is energized for rotation in a direction which will move the window or antenna down.

When the reversing switch 40 is moved to its second On position, designated UP in FIG. 23, the positive battery terminal B+ is connected to the U motor terminal through the switch terminal 134, the contact 124, the contactor 54*b*, the contact 122 and the terminal 138. The negative battery terminal G− is connected to the D motor terminal through the switch terminal 136, which includes the second crossover conductor, the contact 112, the contactor 54*a*, the contact 114 and the switch terminal 140.

The diagrammatic views of FIGS. 21–23 illustrate the various relationships between the length of the contactors 54*a* and 54*b* and the spanning distances between the various contacts 111–114 and 121–124. As illustrated in FIG. 21, in which the switch 40 is in its OFF position, the length of the contactor 54*a* is such as to span or bridge the contacts 112 and 113. Similarly, the length of the contactor 54*b* is such as to span or bridge the contacts 122 and 123. It will be seen that the length of the contactors 54*a* and 54*b* is somewhat greater than the center-to-center distance between the contacts 112 and 113, or the center-to-center distance between the contacts 122 and 123.

As the contactors 54*a* and 54*b* are moved toward the first ON position, designated DOWN in FIG. 22, the contactors 54*a* and 54*b* remain in engagement with the contacts 113 and 123, throughout this movement. The contactor 54*b* engages the contact 121 and then is disengaged from the contact 122, without any change in the circuit, because the contacts 121 and 122 are connected together by the terminal 138. The contactor 54*a* is disengaged from the contact 112, so as to break the short circuit which exists across the motor 142 when the switch 40 is in its OFF position. The contactor 54*a* then engages the contact 111 to close the energizing circuit between the battery and the motor 142. The spacing between the contacts 111 and 112 is sufficiently great to insure that the contactor 54*a* is disengaged from the contact 112 before the contactor 54*a* is engaged with the contact 111. When the contactors are returned to their OFF position, the contactor 54*a* breaks the energizing circuit by moving out of engagement with the contact 111. As the breaking of the circuit occurs, the contactor 54*a* is engaging the insulating arm 132*a*, which keeps the contactor 54*a* away from the terminal board 70, so that the arcing between the contactor 54*a* and the contact 111 is kept away from the terminal board 70. Thus, burning or other damage to the terminal board 70 is prevented or minimized. The insulating member 132 is made of a material which is highly resistant to heat so that the arm 132*a* is able to withstand the arcing between the contact 111 and the contactor 54*a*. The contact 111 is preferably plated with silver or tin to maintain low electrical contact resistance, even when the contact 111 is heated by the heavy current flow and the arcing which occur under severe service conditions.

A similar sequence occurs when the switch is moved from its OFF position of FIG. 21 toward the second ON position, designated UP in FIG. 23. The contactors 54*a* and 54*b* continue to engage the contacts 112 and 122 throughout this movement. The contactor 54*a* engages the contact 114 and then is disengaged from the contact 113, without any change in the circuit, because the contacts 113 and 114 are connected together by the terminal 40. The contactor 54*b* is disengaged from the contact 123, so as to break the shortcircuit which exists across the motor 142 when the switch 40 is in its OFF position. The contactor 54*b* then engages the contact 124 to close the energizing circuit between the battery and the motor 142. The spacing between the contacts 123 and 124 is sufficiently great to insure that the contactor 54*b* is disengaged from the contact 123 before the contactor 54*b* is engaged with the contact 124. When the contactors are returned to their OFF position, the contactor 54*b* breaks the energizing circuit by moving out of engagement with the contact 124. As the breaking of the circuit occurs, the contactor 54*b* is engaging the insulating arm 132*b*, which keeps the contactor away from the terminal board 70, so that the arcing between the contactor and the contact 124 is kept away from the terminal board. Thus, burning or other damage to the terminal board 70 is prevented or minimized. The insulating arm 132*b* is made of a material which is highly resistant to arcing. To maintain low contact resistance under conditions of high heat, the contact 124 is preferably plated with silver or tin. It will be noted that the contacts 111 and 124 are positively polarized, so that the heat due to arcing is primarily concentrated on the contact points 111 and 124, rather than on the contactors 54*a* and 54*b*.

As the contactors 54*a* and 54*b* return to their OFF position, the contactor 54*b* engages the contact 123 to shortcircuit the armature of the motor 142. This shortcircuit causes dynamic braking of the motor.

It will be seen from FIGS. 26–28 that the insulating carriage 52 is formed with a slot or groove 156 on its rear side to afford clearance for the first crossover conductor 130, which projects edgewise in a forward direction from the insulating terminal board 70. The rear side of the insulating carriage 52 is formed with tabs or runners 158 which are slidable along the terminal board 70. Similarly, the front side of the insulating carriage 52 is formed with ridges or runners 160, slidable along the front wall of the housing 42.

As shown particularly in FIGS. 12–16, the first contact 111 in the first row and the fourth contact 124 in the second row project forwardly a greater distance from the terminal board 70 than do the other contacts 112–114 and 121–123. This is due partly to the fact that the terminal flanges 130*a* and 130*b* of the first crossover bar 130 are clamped under the contacts 111 and 124. It will be seen that the contacts 111 and 124 are spherically rounded in shape, so that the contactors 54*a* and 54*b* will ride smoothly and easily, into and out of engagement with the contacts 111 and 124. The arms 132*a* and 132*b* of the insulating member 132 assist in this smooth movement of the contactors. As shown particularly in FIGS. 14 and 15, the contacts 112–114 and 121–123 are substantially flat in shape, with rounded edge portions. With this construction, the contactors 54*a* and 54*b* ride smoothly along the contacts 112–114 and 121–123.

Figure 15:
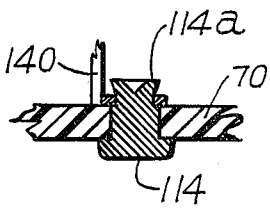
FIG. 15 is a fragmentary section taken through one of the contact rivets, generally along the line 15—15 in FIG. 13.
Figure 16:
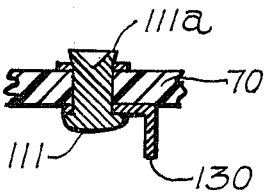
FIG. 16 is a fragmentary section taken through another contact rivet, generally along the line 16—16 in FIG. 12.
Figure 14:
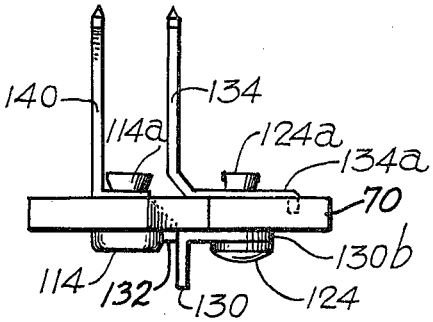
FIG. 14 is an end view of the terminal head assembly, taken generally as indicated by the line 14—14 in FIG. 13.
Figure 17:
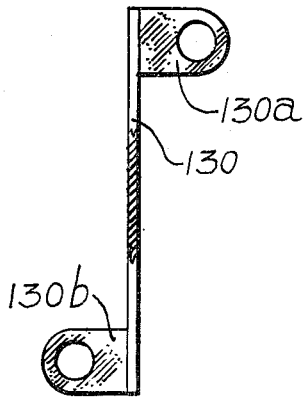
FIGS. 17 and 18 are front and side views of a cross-over conductor, also shown in FIG. 12.
Figure 18:
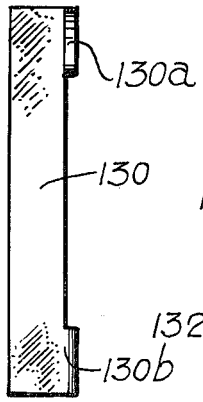

It will be understood that the construction of the crossover bar 130 is applicable to various switches having three or more contacts in each row of contacts. The crossover bar 130 is between the rows of contacts and thus does not obstruct the movement of the contactors. The construction of the insulating member 132 is applicable to various switches having a crossover bar extending between two contacts in different rows. The insulating member is held captive between the crossover bar and the insulating terminal board or wall. As shown in FIG. 15, the rivets 112–114 and 121–123 have shanks such as 114*a* which are shouldered to provide for the development of increased clamping forces between the rivets and the corresponding terminals 136, 138 and 140.

We claim:

1. An electrical reversing switch, comprising a housing, first and second conductive contactors movable in said housing, means in said housing for moving said contactors along first and second predetermined parallel paths, an insulating terminal board on said housing and extending adjacent said paths, first and second rows of contact rivets on said terminal board and selectively engageable by said respective contactors, each of said rows comprising four contact rivets spaced along the path of the corresponding contactor, said contactors being movable to an OFF position in which each contactor forms a bridge between the second and third contact rivets in the corresponding row, said contactors being movable to a first ON position in which each contactor forms a bridge between the first and third contact rivets in the corresponding row, said contactors being movable in the opposite direction to a second ON position in which each contactor forms a bridge between the second and fourth rivets in the corresponding row, said rivets having heads on the inner side of said terminal board and engageable by said contactors, said rivets having shanks extending through said terminal board to the outer side thereof, said terminal board having openings for receiving said shanks, a first crossover conductor extending between the heads of the first contact rivet in the first row and the fourth contact rivet in the second row, said first crossover conductor extending along said terminal board between said first and second rows, a first terminal connected to the shank of one of the contact rivets engaged by said first crossover conductor, a second crossover conductor on the outer side of said terminal board and connected between the shanks of the second contact rivet in the first row and the third contact rivet in the second row, a second terminal connected to said second crossover conductor, a third terminal on the outer side of said terminal board and connected to the shanks of the third and fourth rivets in said first row, and a fourth terminal on the outer side of said terminal board and connected to the shanks of the first and second rivets in the second row.

2. An electrical reversing switch according to claim 1, in which said second crossover conductor comprises a terminal bar projecting rearwardly from said terminal board and having first and second flanges extending in opposite directions therefrom, said first and second flanges being connected to the shanks of the second rivet in the first row and the third rivet in the second row, respectively.

3. An electrical reversing switch according to claim 1, in which said first crossover conductor comprises a connector bar extending edgewise along the inner side of said terminal board and projecting forwardly therefrom, said connector bar having first and second flanges extending laterally in opposite directions from opposite end portions of said connector bar and connected respectively to the heads of the first rivet in the first row and the fourth rivet in the second row.

4. An electrical reversing switch according to claim 3, including a flat generally Z-shaped insulating member having a longitudinal leg held captive between said terminal board and said connector bar, said longitudinal leg also being held captive between said first and second rows of contact rivets, said insulating member having a first lateral leg extending between the heads of the first and second contact rivets in said first row to keep the first contactor away from the terminal board, said insulating member having a second lateral leg extending between the heads of the third and fourth rivets in said second row to keep the second contactor away from the terminal board, said lateral legs of said insulating member being effective to prevent the terminal board from being burned by arcing between each contactor and the corresponding rivets.

5. An electrical reversing switch according to claim 4, in which said insulating member is made of a heat resistant material to minimize damage to the insulating member due to such arcing.

6. An electrical reversing switch, comprising a housing, first and second conductive contactors movable in said housing, means in said housing for moving said contactors along first and second predetermined parallel paths, said housing including insulating means, first and second rows of contacts on said insulating means and selectively engageable by said respective contactors, each of said rows comprising at least three contacts spaced along the path of the corresponding contactor, and a crossover conductor extending between the first contact in the first row and the last contact in the second row, said crossover conductor extending along the front of said insulating means between said first and second rows of contacts.

7. An electrical reversing switch according to claim 6, in which said crossover conductor comprises a connector bar extending along the front of said insulating means and projecting forwardly therefrom.

8. An electrical reversing switch according to claim 6, in which said crossover conductor comprises a connector bar extending edgewise along the front of said insulating means and projecting forwardly therefrom, said connector bar having first and second flanges extending laterally in opposite directions from opposite end portions of said connector bar and connected respectively to the first contact in the first row and the last contact in the second row.

9. An electrical reversing switch according to claim 6, in which said crossover conductor comprises a connector bar extending along the front of said insulating means and projecting forwardly therefrom between said first and second rows of contacts, said switch including an insulating member held captive between said insulating means and said connector bar and having first and second portions extending across said rows of contacts adjacent said first contact in said first row and said last contact in said last row to protect said insulating means from the heat produced by arcing between said first and last contacts and the corresponding first and second contactors.

10. An electrical reversing switch according to claim 9, in which said insulating member is made of a heat resistant material capable of resisting the heat due to such arcing.

11. An electrical reversing switch, comprising a housing, first and second conductive contactors movable in said housing, said housing having an insulating wall, first and second rows of contacts on the front of said insulating wall and selectively engageable by said respective contactors, each of said rows comprising at least three contacts spaced along the path of the corresponding contactor, a crossover conductor extending between the first contact in the first row and the last contact in the second row, said crossover conductor comprising a connector bar extending along the front of said insulating wall between said first and second rows, and a flat insulating member held captive between said connector bar and said insulating wall and having first and second portions extending across said rows adjacent said first and last contacts to protect said insulating wall from the heat of arcing between said respective first and last contacts and the corresponding first and second contactors, said insulating member being made of a heat resistant material, said first and second contactors being engageable with said first and second portions of said insulating member in moving into and out of engagement with said respective first and last contacts.

12. An electrical reversing switch according to claim 11, in which said insulating member has a longitudinal leg held captive between said connector bar and said insulating wall, said first and second portions of said insulating member being in the form of arms projecting laterally from said longitudinal leg.

13. An electrical reversing switch, comprising a housing, first and second conductive contactors movable in said housing, means in said housing for moving said contactors along first and second predetermined parallel paths, said housing including an insulating wall, first and second rows of contacts on the front of said insulating wall and selectively engageable by said respective contactors, each of said rows comprising four contacts spaced along the path of the corresponding contactor, said contacts having elements extending through said insulating wall to the rear side thereof, said insulating wall having openings for receiving said elements, said first and second contactors being movable into bridging relation with pairs of said contacts in the corresponding rows, and a crossover terminal on the rear side of said insulating wall and connected between said elements of the second contact in the first row and the third contact in the second row.

14. An electrical reversing switch according to claim 13, in which said crossover terminal comprises a terminal bar projecting rearwardly from said insulating wall and having first and second flanges extending in opposite directions therefrom and connected to said elements of the second contact in the first row and the third contact in the second row.

15. An electrical reversing switch, comprising a housing, first and second conductive contactors movable in said housing, means in said housing for moving said contactors along first and second predetermined parallel paths, said housing including an insulating wall, first and second rows of contacts on the front of said insulating wall and selectively engageable by said respective first and second contactors, each of said rows comprising four contacts spaced along the path of the corresponding contactor, said contactors being movable into bridging relation with pairs of the contacts in the corresponding first and second rows, said contacts having elements extending through said insulating wall to the rear side thereof, said insulating wall having openings for receiving said elements, a first crossover conductor extending along the front of said insulating wall between said first and second rows of contacts and connected between the first contact in the first row and the fourth contact in the second row, and a second crossover conductor on the rear side of said insulating wall and connected between said elements of the second contact in the first row and the third contact in the second row.

16. An electrical reversing switch according to claim 15, in which said second crossover conductor comprises a terminal bar projecting rearwardly from said insulating wall and having first and second flanges extending in opposite directions and connected to said elements of the second contact in the first row and the third contact in the second row.

17. An electrical reversing switch according to claim 15, including a first terminal connected to the element of one of the contacts engaged by said first crossover conductor, said second crossover conductor comprising a second terminal projecting rearwardly from said insulating wall and having first and second flanges extending in opposite directions and connected to the elements of the second contact in the first row and the third contact in the second row, a third terminal connected to the elements of the third and fourth contacts in the first row, and a fourth terminal connected to the elements of the first and second contact in the second row.

18. An electrical switch, comprising a housing having an insulating wall, first and second rows of contacts on the front of said insulating wall, contactor means movable in said housing and selectably engageable with said contact, a crossover conductor extending between contacts in said first and second rows, said crossover conductor comprising a connector bar extending along the front of said insulating wall between said first and second rows, and a flat insulating member held captive between said connector bar and said insulating wall and having at least one portion extending across one of said rows adjacent a particular contact therein to protect said particular contact against heat due to arcing between said particular contact and said contact means, said insulating member being made of a heat resistant material.

19. An electrical switch according to claim 18, in which said insulating member is also held captive between the contacts of said first and second row against lateral movement.

20. An electrical switch according to claim 18, in which said insulating member has portions extending across both of said rows adjacent particular contacts in said rows.

* * * * *

UNITED STATES PATENT AND TRADEMARK OFFICE

CERTIFICATE OF CORRECTION

PATENT NO. : 4,168,405

DATED : September 18, 1979

INVENTOR(S) : Andrew F. Raab and William J. Schaad

It is certified that error appears in the above-identified patent and that said Letters Patent are hereby corrected as shown below:

Column 1, immediately before numbered line 4, insert the heading -- FIELD OF THE INVENTION --

Column 1, after numbered line 8, "FIELD OF THE INVENTION" should be -- DESCRIPTION OF PRIOR ART --

Column 1, after numbered line 18, "DESCRIPTION OF PRIOR ART" should be -- OBJECTS OF THE INVENTION --

Column 9, line 37, "40" should be -- 140 --

Signed and Sealed this

*Eighteenth* Day of *December 1979*

[SEAL]

*Attest:*

*Attesting Officer*

SIDNEY A. DIAMOND

*Commissioner of Patents and Trademarks*